US011058224B2

(12) United States Patent
Ludwig et al.

(10) Patent No.: US 11,058,224 B2
(45) Date of Patent: Jul. 13, 2021

(54) SEATING COMPONENTS WITH LAMINATED BONDING MATERIAL

(71) Applicant: Steelcase Inc., Grand Rapids, MI (US)

(72) Inventors: James Nolan Ludwig, East Grand Rapids, MI (US); Bruce M. Smith, East Grand Rapids, MI (US); Carl V. Forslund, III, Grand Rapids, MI (US); Christopher J. Norman, Middleville, MI (US); Gordon J. Peterson, Rockford, MI (US); Fredric Biddle, Kalamazoo, MI (US); Nickolaus William Charles Deevers, Holland, MI (US)

(73) Assignee: Steelcase Inc., Grand Rapids, MI (US)

( * ) Notice: Subject to any disclaimer, the term of this patent is extended or adjusted under 35 U.S.C. 154(b) by 147 days.

(21) Appl. No.: 16/241,496

(22) Filed: Jan. 7, 2019

(65) Prior Publication Data

US 2019/0133324 A1 May 9, 2019

Related U.S. Application Data

(63) Continuation of application No. 15/095,761, filed on Apr. 11, 2016, now Pat. No. 10,182,656.

(60) Provisional application No. 62/146,670, filed on Apr. 13, 2015.

(51) Int. Cl.

| | |
|---|---|
| *A47C 7/14* | (2006.01) |
| *A47C 7/26* | (2006.01) |
| *A47C 7/28* | (2006.01) |

(52) U.S. Cl.
CPC ..... *A47C 7/14* (2013.01); *A47C 7/26* (2013.01); *A47C 7/28* (2013.01)

(58) Field of Classification Search
CPC .... A47C 7/14; A47C 7/26; A47C 7/28; A47C 7/32; A47C 7/144
See application file for complete search history.

(56) References Cited

U.S. PATENT DOCUMENTS

| | | | |
|---|---|---|---|
| 1,405,511 | A | 2/1922 | Hirshfield |
| 2,792,320 | A | 5/1957 | Bower |
| 3,107,944 | A | 10/1963 | Baermann |
| 3,234,668 | A | 2/1966 | Radcliffe |
| 3,241,340 | A | 3/1966 | Herbert |
| 3,249,984 | A | 5/1966 | Storti |
| 3,251,727 | A | 5/1966 | Reynolds et al. |
| 3,642,563 | A | 2/1972 | Davis et al. |
| 3,957,243 | A | 5/1976 | Costin et al. |

(Continued)

FOREIGN PATENT DOCUMENTS

| | | |
|---|---|---|
| WO | 2004037046 | 5/2004 |

*Primary Examiner* — David R Dunn
*Assistant Examiner* — Tania Abraham
(74) *Attorney, Agent, or Firm* — Price Heneveld LLP

(57) ABSTRACT

A seating support arrangement includes a seating frame, a cover member supported by the seating frame, the cover member having a first elastic modulus in a first direction, the cover member having an outer surface area and a support area that is less than the outer surface area and is configured to support a user, and a polymer film surface layer attached to the support area of the cover member such that the combination of the cover member in the support area and the surface layer has a second elastic modulus in the first direction that is greater than the first elastic modulus.

23 Claims, 6 Drawing Sheets

(56) References Cited

U.S. PATENT DOCUMENTS 4,015,448 A 4/1977 Knohl
4,077,669 A 3/1978 Fox
4,079,568 A * 3/1978 Wortman ..... B32B 5/24 53/432
4,305,988 A * 12/1981 Kocher ..... B29C 66/433 428/158
4,333,978 A 6/1982 Kocher
4,607,439 A 8/1986 Sogabe et al.
4,750,339 A 6/1988 Simpson, Jr. et al.
4,810,558 A 3/1989 Hornung et al.
4,998,773 A 3/1991 Pesce
5,013,089 A 5/1991 Abu-Isa et al.
5,092,654 A * 3/1992 Inaba ..... B60N 2/667 297/284.7
5,255,538 A 10/1993 Day et al.
5,465,594 A 11/1995 Imboden et al.
6,102,482 A 8/2000 Dettoni et al.
6,227,010 B1 5/2001 Roell
6,254,190 B1 7/2001 Gregory
6,299,962 B1 10/2001 Davis et al.
6,361,117 B1 * 3/2002 Tate ..... B60N 2/70 297/452.56
6,497,786 B1 12/2002 Kilgore et al.
6,632,756 B1 10/2003 Waldrop et al.
6,739,158 B2 5/2004 Sciacca
6,769,146 B2 8/2004 Copeland et al.
6,808,791 B2 10/2004 Curro et al.
6,817,667 B2 11/2004 Pennington et al.
6,878,433 B2 4/2005 Curro et al.
6,910,288 B2 6/2005 Dua
7,033,458 B2 4/2006 Chang et al.
7,229,518 B1 6/2007 Watkins
7,270,378 B2 9/2007 Wilkerson et al.
7,406,733 B2 8/2008 Coffield et al.
7,481,079 B1 1/2009 Waldrop et al.
7,481,493 B2 1/2009 Fujita et al.
7,631,941 B2 12/2009 Chang
8,028,386 B2 10/2011 Rock et al.
D648,588 S * 11/2011 Rice Golin ..... D6/611
8,128,457 B2 3/2012 Reinisch et al.
8,354,144 B2 1/2013 Grynaeus et al.
8,419,135 B2 4/2013 Moeseneder et al.
8,506,865 B2 8/2013 Wangenheim
8,522,577 B2 9/2013 Huffa
8,578,535 B2 11/2013 Dojan et al.
8,621,891 B2 1/2014 Dua et al.
8,622,472 B2 * 1/2014 Rajaratnam ..... A47C 7/40 297/284.2
8,745,896 B2 6/2014 Dua et al.
8,800,172 B2 8/2014 Dua et al.
8,960,699 B2 * 2/2015 Sprigle ..... A61G 5/02 280/250.1
9,334,588 B2 5/2016 Kosui et al.
10,016,060 B2 7/2018 Schmitz et al.
2004/0040640 A1 3/2004 Bordes
2004/0160109 A1 8/2004 Bottemiller
2005/0130537 A1 6/2005 Phelps
2007/0141937 A1 6/2007 Hendrix et al.
2008/0106134 A1 5/2008 Heidmann et al.
2009/0107012 A1 4/2009 Cheney et al.
2012/0100351 A1 4/2012 Covelli et al.
2012/0183748 A1 7/2012 Schindler et al.
2013/0067768 A1 3/2013 Dua et al.
2013/0186054 A1 7/2013 Cross et al.
2013/0189890 A1 7/2013 Cross et al.
2013/0190917 A1 7/2013 Cross et al.
2013/0263356 A1 10/2013 Jones et al.
2013/0288554 A1 10/2013 Mallen et al.
2014/0059886 A1 3/2014 Lyttle et al.
2014/0157623 A1 6/2014 Dekovic
2014/0209233 A1 7/2014 Dua et al.
2014/0245638 A1 9/2014 Seamarks et al.
2016/0206102 A1 7/2016 Aldrich et al.
2018/0317658 A1 11/2018 Schmitz et al.

* cited by examiner

SEATING COMPONENTS WITH LAMINATED BONDING MATERIAL

BACKGROUND OF THE INVENTION

The present invention relates to a seating assembly, and in particular to a seating assembly that includes a laminated support surface, wherein the surface can be configured to enhance mechanical properties of a supporting cover material, as well as to control the geometrical configuration or shape of the overall supporting surface.

BRIEF SUMMARY OF THE INVENTION

One aspect includes a seating support arrangement that includes a seating frame, a cover member supported by the seating frame, the cover member having a first elastic modulus in a first direction, the cover member having an outer surface area and a support area that is less than the outer surface area and is configured to support a user, and a polymer film surface layer attached to the support area of the cover member such that the combination of the cover member in the support area and the surface layer has a second elastic modulus in the first direction that is greater than the first elastic modulus.

Another aspect includes a method for constructing a seating support arrangement that includes providing a seating frame, providing a cover member having a first elastic modulus in a first direction, the cover member having an outer surface area and a support area that is less than the outer surface area and is configured to support a user, attaching a polymer film surface layer to the support area of the cover member such that the combination of the cover member in the support area and the surface layer has a second elastic modulus in the first direction that is greater than the first elastic modulus, and supporting the cover and the surface layer by the seating frame.

Yet another aspect includes a seating support arrangement that includes a cover member having a first rigidity, the cover member having an outer surface area and a shaped area that is less than the outer surface area, wherein the cover member is configured to support a seated user, and a polymer film surface layer attached to the shaped area of the cover that is less than the outer surface area of the cover such that the combination of the cover member in the shaped area and the surface layer has a second rigidity that is greater than the first rigidity.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
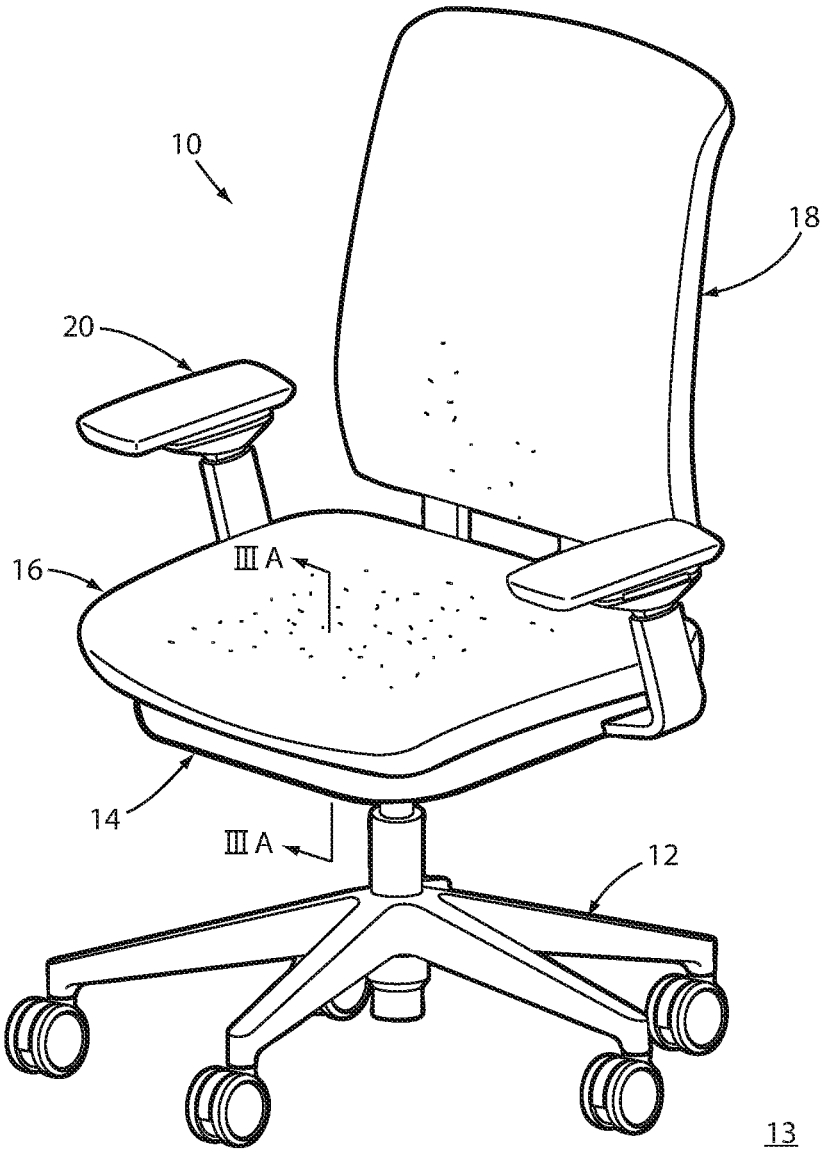
FIG. 1 is a perspective view of a seating arrangement embodying the present invention.
Figure 2:
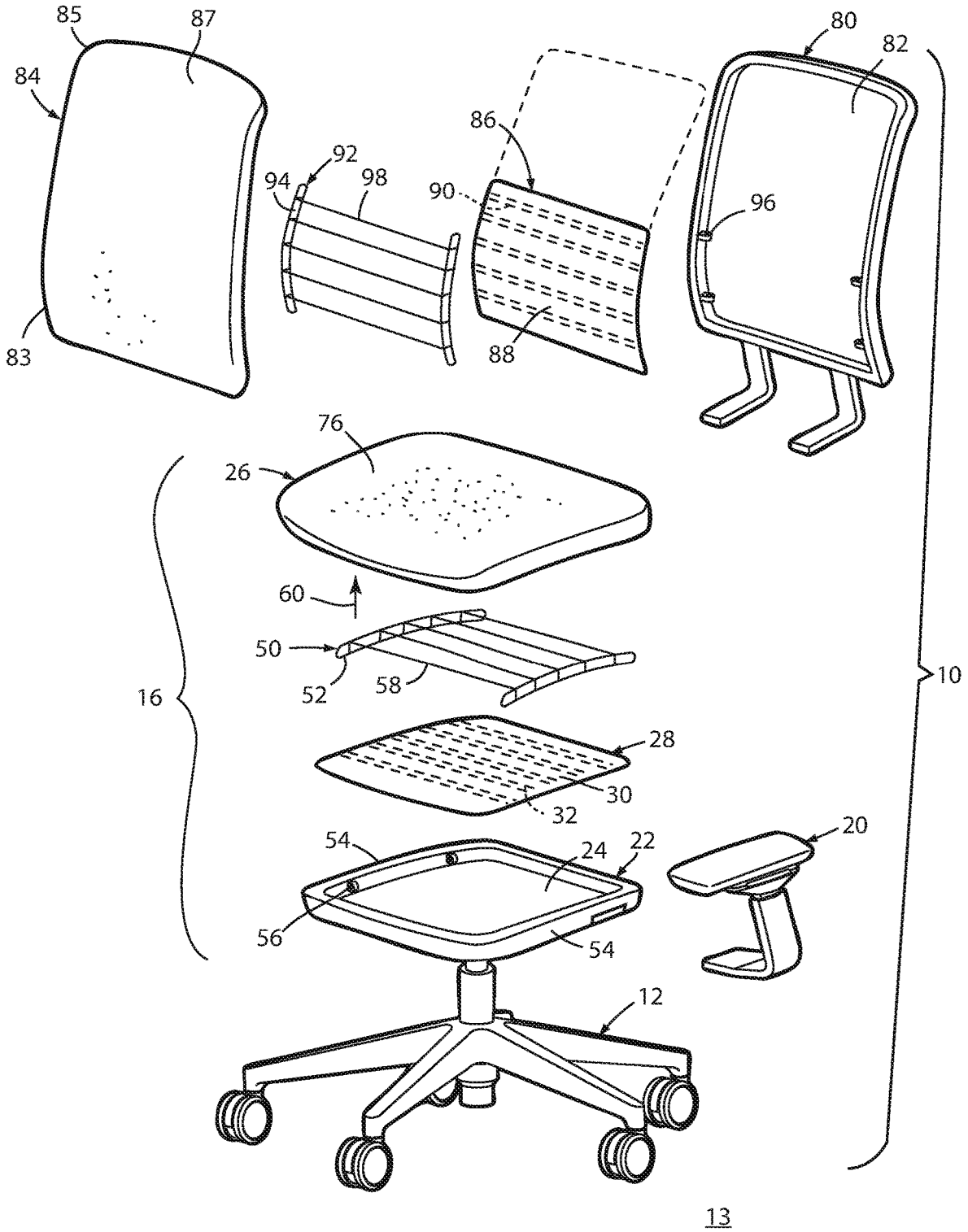
FIG. 2 is an exploded perspective view of the seating arrangement of FIG. 1.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a seating arrangement embodying the present invention. In the illustrated example, the seating arrangement 10 comprises an office chair assembly, however, it is noted that the present invention may be incorporated into various seating arrangements, including but not limited to, office seating, vehicle seating, home seating, stadium seating, theater seating, and the like. The seating arrangement 10 includes a castered base assembly 12 abutting a supporting floor surface 13, a control or support assembly 14 supported by the castered base assembly 12, a seat assembly 16 and a back assembly 18 each operably coupled with the control assembly 14, and a pair of arm assemblies 20.

The seat assembly or seating support arrangement 16 (FIGS. 2 and 3A) includes a seating frame arrangement 22 including a recess 24 defined therein. The seat assembly 16 further includes a flexible cover member 26 that is supported by the seating frame 22 as described below. In the illustrated example, the flexible cover member 26 includes a first surface 25 and a second surface 27 opposite the first surface 25, and comprises a woven fabric, however various materials may also be utilized, including non-woven fabrics, polymeric materials, leather, and the like. The seat assembly 16 further includes a surface layer 28 attached to the cover member 26. As shown, the surface layer 28 comprises a sheet of polymeric film material such as a polyester, however other suitable materials may also be utilized depending upon the particular application and the mechanical properties and/or shape control required. In the illustrated example, the surface layer 28 includes a first surface 29 and a second surface 31 opposite the first surface 29. The surface layer 28 further includes laterally extending first portions 30 attached to the cover member 26 and a plurality of laterally extending second portions 32 interspaced with the first portions 30 and which are not attached to cover member 26, thereby creating a plurality of laterally extending tunnels 4, as described below.

The seat assembly 16 further includes an elastically resilient control arrangement 50 that is supported by the seating frame 22 above the recess 24, and is positioned between the cover member 26 and the surface layer 28. In the illustrated example, the control arrangement 50 includes a pair of flexibly resilient flexing members 52 attached to the sides 54 of the seating frame 22 by mechanical fasteners 56. The control arrangement 50 further includes a plurality of support members 58 coupled to and extending laterally between the flexing members 52. In the illustrated example, the support members 58 comprise a plurality of flexibly resilient, tensioned wire members each having a circular cross-sectional configuration. However, it is noted that variously configured support members comprising various materials may be utilized.

Figure 3A:
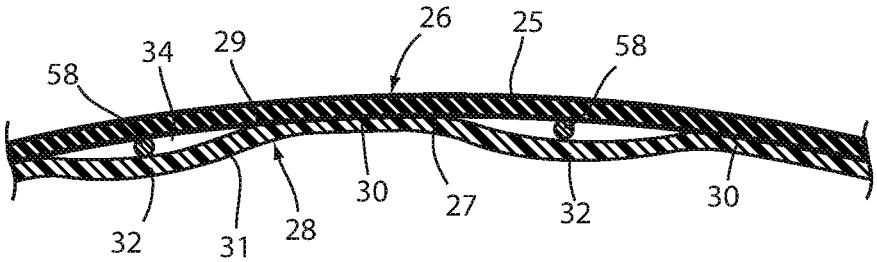
FIG. 3A is a cross-sectional side elevational view of a cover member and a surface layer taken along the line IIIA-IIIA, FIG. 1.
Figure 4:
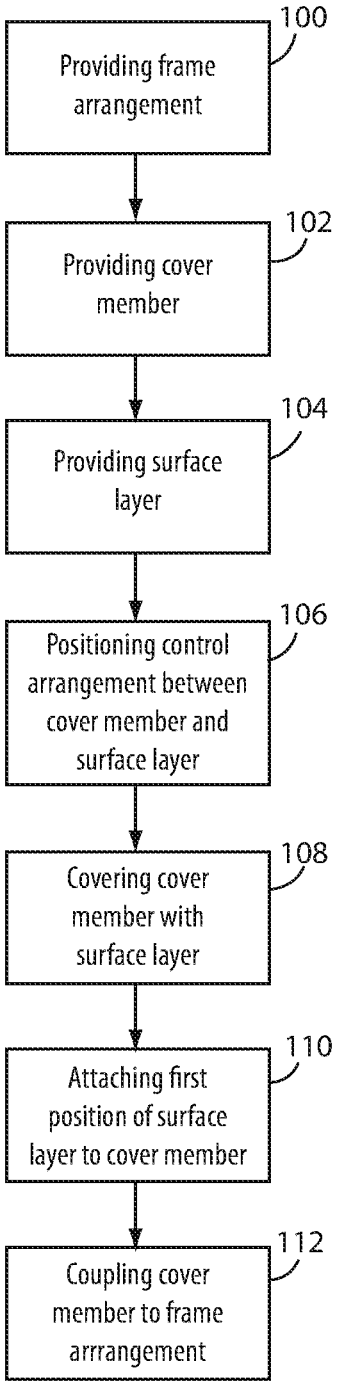
FIG. 4 is a schematic view of a method for constructing a seating support arrangement in accordance with the present invention.

As best illustrated in FIG. 3A, the seat assembly 16 is constructed such that the elongated support members 58 extend laterally through the tunnels 34, and are allowed to freely move with respect to the cover member 26 and the surface layer 28. Specifically, the seat assembly 16 is constructed by aligning the control arrangement 50 with the cover member 26 and the surface layer 28 such that the support members 58 of the control arrangement 50 are positioned between the cover member 26 and the surface layer 28. The first portions 30 of the surface layer 28 are then attached to the second surface 27 of the cover member 26, thereby creating the tunnels 34 within which the support members 58 extend and are allowed to freely move with respect to the cover member 26 and the surface layer 28. In the illustrated example, the first surface 29 of the surface layer 28 is preferably bonded to the second surface 27 of the cover member 26 via thermal bonding, sonic welding, laser welding, and the like, however other attachment methods may be utilized, such as adhesion, stitching, and the like. As an overview, FIG. 4 outlines the method for constructing the seating support arrangement 16 includes providing the frame arrangement 100, providing the cover member 102, providing the surface layer 104, positioning the control arrangement between the cover member and the surface layer 106, covering at least a portion of the cover member with the surface layer 108, attaching the first portions of the surface layer with the cover member 100, and coupling the cover member with the frame arrangement 112. Of course, alternative step sequences may also be utilized, such as attaching the surface layer with cover member 110 prior to positioning the control arrangement with respect to the cover member and the surface layer 106.

It is noted that the first surface 29 of the surface layer 28 in the areas aligned with the second portions 32 of the surface layer 28 may be pre-treated so as to prevent bonding of the second portions 32 of the surface layer 28 with the second surface 27 of the cover member 26. Alternatively, a boundary layer 33 (FIG. 3B) may be positioned between the second portions 32 of the surface layer 28 and the second surface 27 of the cover member 26 such that the cover member 26 is prevented from bonding to the first surface 29 of the surface layer 28 at the second portions 32 thereof.

Figure 3B:
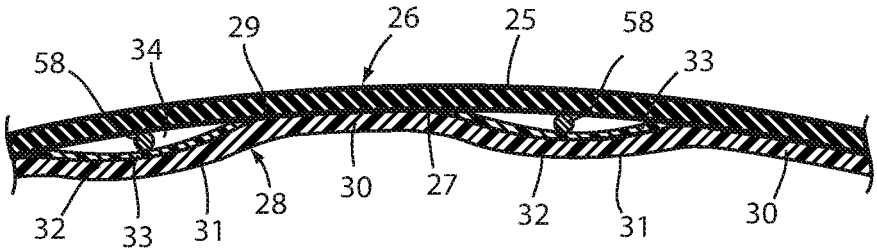
FIG. 3B is a cross-sectional side elevational view of an alternative embodiment of the cover member and the surface layer.
Figure 3C:
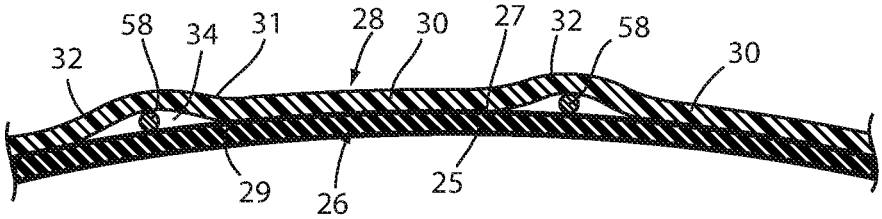
FIG. 3C is a cross-sectional side elevational view of a second alternative embodiment of the cover member and the surface layer.

It is further noted that while FIGS. 3A and 3B show the cover member 26 and the surface layer 28 being arranged with respect to one another such that the first surface 25 of the cover member 26 forms the outer aesthetic surface of the seating support arrangement 16, the cover member 26 and the surface layer 28 may be arranged such that the surface layer 28 provides the outer aesthetic surface for the seating support arrangement 16, such as that illustrated in FIG. 3C. In this arrangement, the surface layer 28 may be provided in a pattern onto the cover member 26 or have a pattern created thereon or therein to provide the outer aesthetic appearance of the seating support structure 16 either individually or in cooperation with the cover member 26. Moreover, it is noted that the surface layer 28 may be transparent, translucent, or opaque, or combinations thereof.

Figure 5:
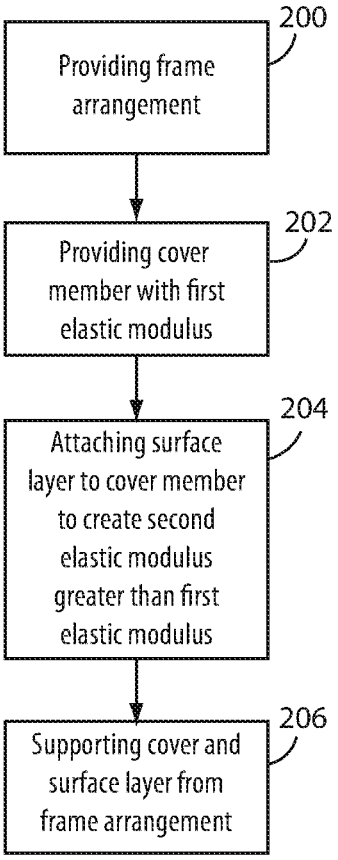
FIG. 5 is a schematic view of an alternative method for constructing a seating support arrangement.

Moreover, the surface layer 28 may be configured and/or patterned in a manner so as to cooperate with the cover member 26 to provide to or alter the mechanical properties of the cover member 26. For example, the surface layer 28 may be attached to the cover member 26 such that the elastic modulus of the combination of the cover member 26 and the surface layer 28 together is different from the elastic modulus of the cover member alone, thereby allowing for localized areas of increased support provided to a user. An example of a method that may be utilized to construct a seating support arrangement with a varying elastic modulus includes providing a seating frame arrangement 200 (FIG. 5), providing a cover member having a first elastic modulus 202, attaching a polymer film surface layer to a support area of the cover member such that the cover member and surface layer cooperate to provide a second elastic modulus in the support area that is greater than the first elastic modulus 204, and supporting the cover member and the surface layer from the seating frame arrangement 206.

Figure 7:
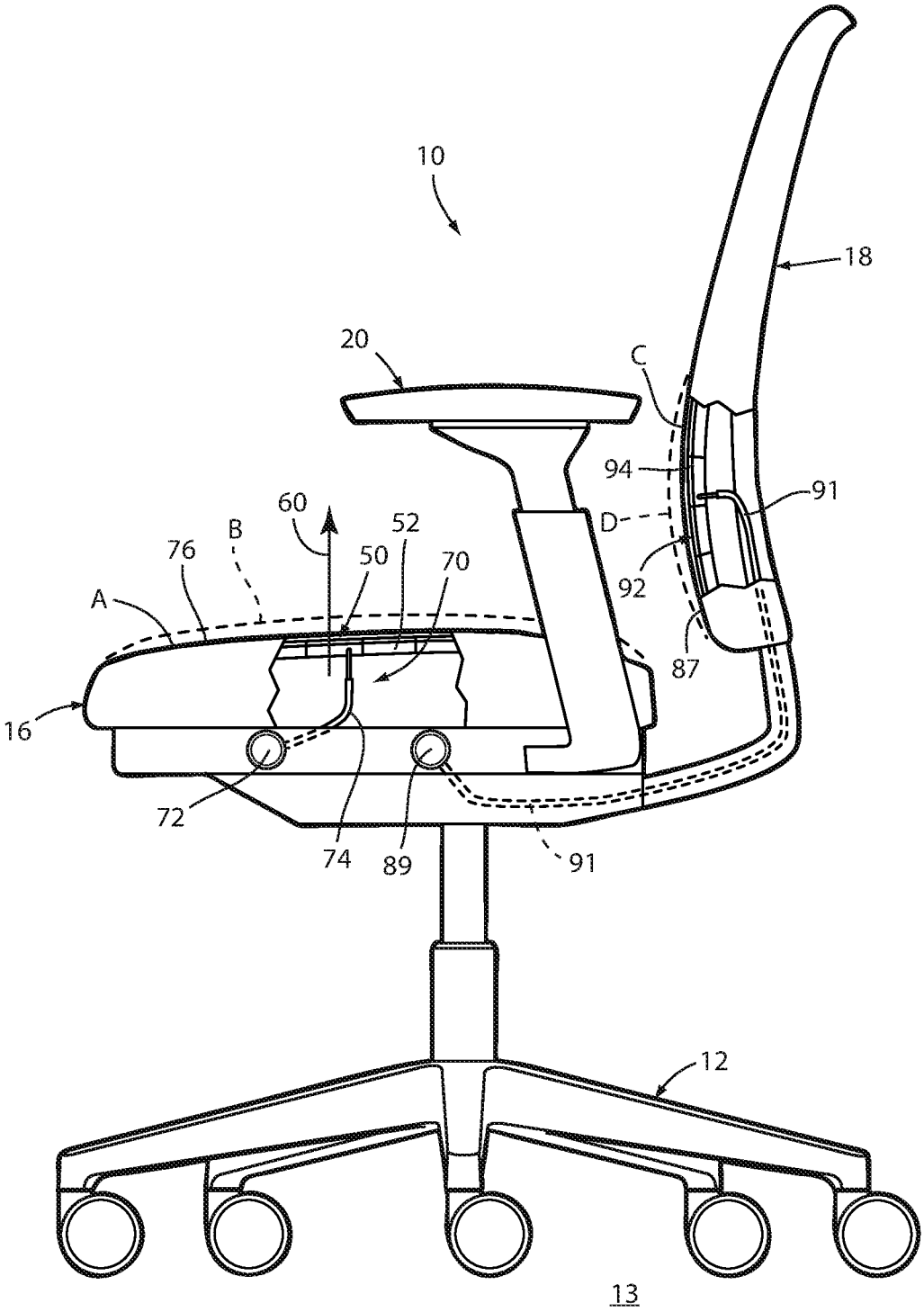
FIG. 7 is a side elevational view of a seating arrangement, wherein a seating assembly and a back assembly are cut-away to show a control assembly.

In the illustrated example, the flexing members 52 are coupled to the seating frame 22 such that the flexing members 52 are flexed and biased in an upward direction 60. As best illustrated in FIG. 7, a control assembly 70 includes a control input arrangement such as a control knob 72 configured to receive an input from a user and operably coupled to at least one of the pair of flexing members 52 via a Bowden cable 74. In operation, a user may reconfigure the supporting surface 76 of the cover member 26 by flexing the flexible members 52 via the control knob 72 and the Bowden cable 74 between a first position A and a second position B. It is noted that while in the illustrated example, the control arrangement 50 is configured to adjust the shape of all or at least the majority of the support surface 76, the control arrangement 50 and the surface layer 28 may be configured to affect, reconfigure or shape only a portion of the support surface 76.

For example, the back assembly or seating support arrangement 18 is constructed in a similar manner to that of the previously described seat assembly 16, but wherein the associated surface layer and/or control assembly do not extend over the entire supporting surface of the back assembly. In the illustrated example, the back assembly 18 includes a back frame 80 that includes a recess 82, a cover member 84 and a surface layer 86. The surface layer 86 includes a plurality of first portions 88 and second portions 90 that are coupled with the cover member 84 in a similar manner to that described above with respect to the surface layer 28 and the cover member 26, thereby creating a plurality of laterally extending tunnels. A back control arrangement 92 is constructed similar to the control arrangement 50 of the seat assembly 16 and includes a pair of flexing members 94 operably coupled to the back frame 80 via a plurality of mechanical fasteners 96, and a plurality of support members 98 extending through the tunnels located between the cover member 84 and the surface layer 86. In the illustrated example, the surface layer 86 is aligned with a lower portion or lumbar region 83 of the cover member 84 and may or may not be aligned with and attached to an upper portion 85 of the cover member 84. The back control arrangement 92 is aligned with only the lower portion 83 of the cover member 84. In operation, a user may reconfigure a supporting surface 87 of the lower portion 83 of the cover member 84 in a similar manner to that described above with respect to the seat assembly 16, or specifically by flexing the flexing member 94 via a control knob 89 and a Bowden cable 91 between a first position C and a second position D.

Figure 8:
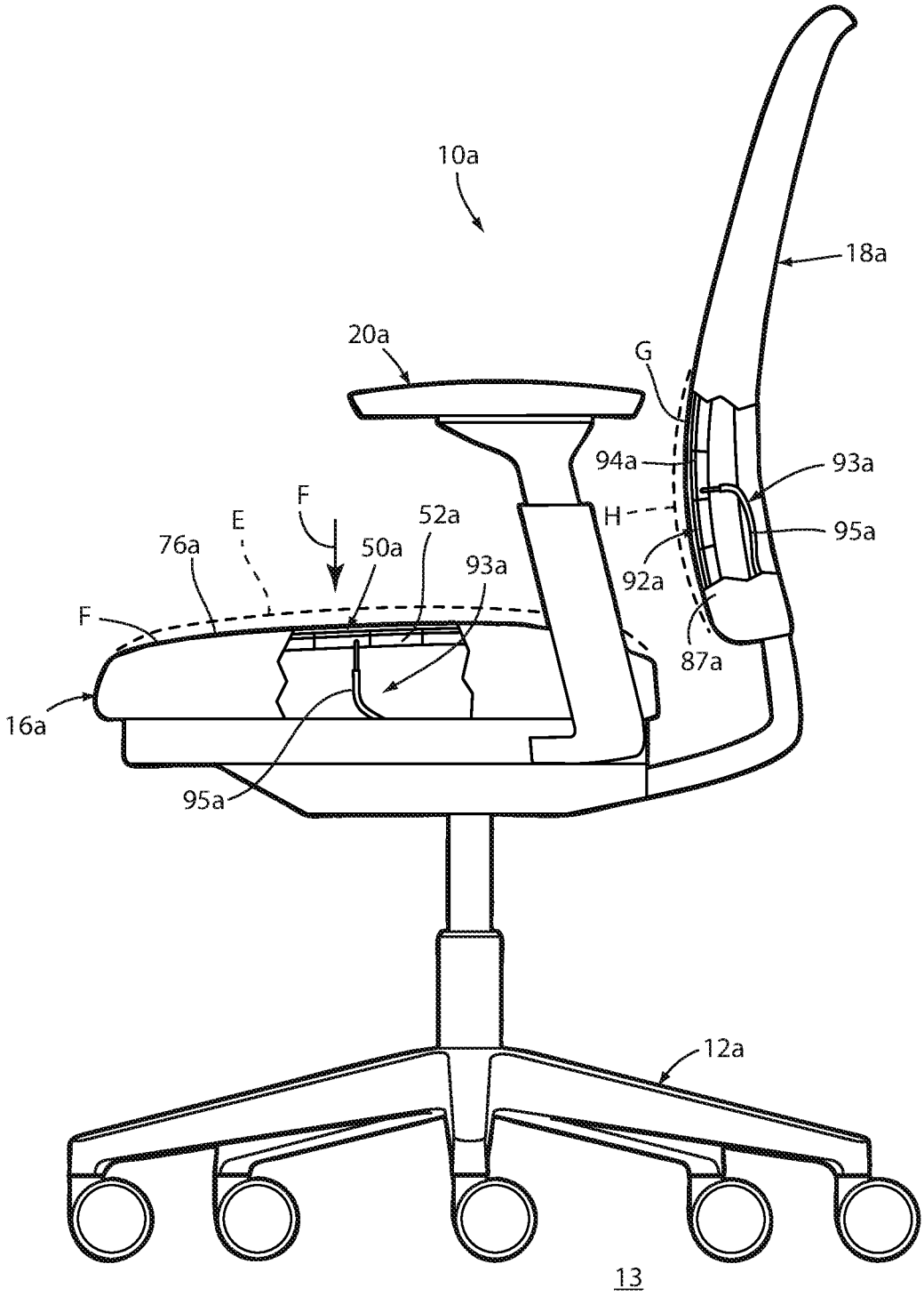
FIG. 8 is a side elevational view of an alternative embodiment of a seating arrangement, wherein a seating assembly and a back assembly are cut-away to show a control assembly

Alternatively, the present invention may be used to couple multiple support surfaces together, such that a force input exerted onto one support surface changes the shape of or reconfigures another support surface. For example, the chair 10*a* (FIG. 8) may be configured such that an input force F exerted onto the seat assembly 16*a* results in a change of shape to the support surface 87*a* of the back assembly via a control assembly 93. Since the chair 10*a* is similar to the previously described chair 10, similar parts appearing in FIG. 7 and FIG. 8 are represented by the same reference numeral, except for the suffix "a" in the numerals of the latter. In the illustrated example, a Bowden cable 95*a* directly couples the flexing members 94*a* of the control arrangement 92*a* of the back assembly 18*a* with the flexing members 52*a* of the control arrangement 50*a* of the seat assembly 16*a*, such that the downwardly directed force F results in a downward deflection of the support surface 76*a* of the seat assembly 16*a* from the position E to the position F, thereby causing the support surface 87*a* of the back assembly 18*a* to deflect from the position G to the position H. While the present example illustrates the automatic adjustment of a lumbar area of a seating back assembly due to a force exerted on a seating assembly by a seated user, it is noted that the concept of reconfiguring and/or reshaping various supporting surfaces as a result of forces exerted on the support surfaces of other supporting arrangements may be used between a wide variety of supporting surfaces and seating components including but not limited to seat assemblies, back assemblies, head rest assemblies, arm assemblies, and the like.

Figure 6:
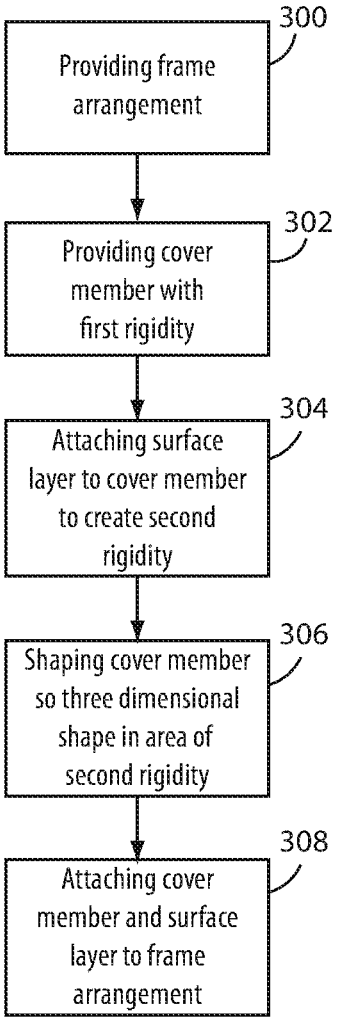
FIG. 6 is a schematic view of a second alternative method for constructing a seating support arrangement.

Similarly, the surface layer 28 may be configured and/or patterned in a manner so as to cooperate with the cover member 26 to alter the rigidity of the material of the cover member 26 alone, thereby allowing the cover member 26 to be pre-shaped prior to assembly with the remainder of the seating support arrangement 16. For example, the surface layer 28 may be attached and molded with the cover member 16 so as to form three dimensional shapes with the cover member for increased structural integrity, improved aesthetics, improving ease of manufacturing and/or assembly, and the like. An example of a method that may be utilized to construct a seating support arrangement with a varying rigidity includes providing a seating support arrangement 300 (FIG. 6) providing a cover member having a first rigidity and a shaped area that is less than the total area 302, attaching the polymer film surface layer to the shaped area such that the shaped area has a rigidity greater than the first rigidity 304, shaping the shaped area into a three dimensional shape 306, and attaching the cover member and the surface layer to the seating frame arrangement while the shaped area substantially retains the three dimensional shape 308.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A seating support arrangement, comprising:

a seating frame;

a cover member supported by the seating frame, the cover member having a first elastic modulus in a first direction, the cover member having an outer surface area configured to support a user when in the seated position and a support area that is less than the outer surface area and is configured to support the user; and a polymer film surface layer attached to the support area of the cover member at locations spaced laterally across the support area to prevent planar movement of the polymer film surface layer at the locations and such that the combination of the cover member in the support area and the surface layer at the locations has a second elastic modulus in the first direction that is greater than the first elastic modulus where the polymer film surface layer is not attached to the cover member.

2. The seating support arrangement of claim 1, wherein the surface layer is substantially transparent.

3. The seating support arrangement of claim 1, wherein the surface layer is attached to the cover member by at least one of adhesion, sonic welding, and laser welding.

4. The seating support arrangement of claim 1, wherein the surface layer is attached to an outer surface of the cover member.

5. The seating support arrangement of claim 4, wherein the surface layer comprises an aesthetic pattern.

6. The seating support arrangement of claim 1, wherein the seating support arrangement comprises a back support assembly.

7. The seating support arrangement of claim 6, wherein the support area is positioned to support the lumbar area of a seated user.

8. The seating support arrangement of claim 1, wherein the polymer film surface layer comprises a polyester.

9. The seating support arrangement of claim 1, wherein the cover member comprises a fabric.

10. A method for constructing a seating support arrangement, comprising:

providing a seating frame;

providing a cover member having a first elastic modulus in a first direction, the cover member having an outer surface area configured to support a seated user and a support area that is less than the outer surface area and is configured to support the seated user;

attaching a polymer film surface layer to the support area of the cover member at locations spaced laterally across the support area to prevent planar movement of the polymer film surface layer at the locations and such that the combination of the cover member in the support area and the surface layer at the locations has a second elastic modulus in the first direction that is greater than the first elastic modulus where the polymer film surface layer is not attached to the cover member; and supporting the cover and the surface layer by the seating frame.

11. A seating support arrangement, comprising:

a cover member having a first elastic modulus in a first direction, the cover member having an outer surface area and a shaped area that is less than the outer surface area, wherein the outer surface area and the shaped area are each configured to support a seated user; and a polymer film surface layer attached to the shaped area of the cover at locations spaced laterally across the shaped area to prevent planar movement of the polymer film surface layer at the locations and such that the combination of the cover member in the shaped area and the surface layer has a second modulus of elasticity in the first direction at the locations that is greater than the first modulus of elasticity where the polymer film surface layer is not attached to the cover member.

12. The seating support arrangement of claim 11, wherein the surface layer is substantially transparent.

13. The seating support arrangement of claim 11, wherein the surface layer is attached to the cover member by at least one of adhesion, sonic welding, and laser welding.

14. The seating support arrangement of claim 11, wherein the surface layer is attached to an outer surface of the cover member.

15. The seating support arrangement of claim 14, wherein the surface layer comprises an aesthetic pattern.

16. The seating support arrangement of claim 11, further comprising:

a seating frame that supports the cover member.

17. The seating support arrangement of claim 11, wherein the seating support arrangement comprises a back support assembly.

18. The seating support arrangement of claim 17, wherein the support area is positioned to support the lumbar area of a seated user.

19. The seating support arrangement of claim 11, wherein the polymer film surface layer comprises a polyester.

20. The seating support arrangement of claim 11, wherein the cover member comprises a fabric.

21. A method for constructing a seating support arrangement, comprising:

providing the seating support arrangement of claim 11;

shaping the shaped area into a three dimensional shape; and attaching the cover member and the surface layer to a frame while the shaped area substantially retains the three dimensional shape.

22. The method for constructing the seating support arrangement of claim 21, wherein the seating support arrangement comprises a back support assembly.

23. The method for constructing the seating support arrangement of claim 22, wherein the support area is positioned to support the lumbar area of a seated user.

* * * * *